US006067965A

United States Patent [19]

Trumpy et al.

[11] Patent Number: 6,067,965

[45] Date of Patent: May 30, 2000

[54] METHOD AND SYSTEM FOR DETERMINING A QUANTITY OF FUEL TO BE INJECTED INTO AN INTERNAL COMBUSTION ENGINE

[75] Inventors: David Karl Trumpy, Farmington Hills; Daniel Lawrence Meyer, Dearborn; Eric Warren Curtis; Leighton Ira Davis, Jr., both of Ann Arbor, all of Mich.

[73] Assignee: Ford Global Technologies, Inc., Dearborn, Mich.

[21] Appl. No.: 09/144,150

[22] Filed: Aug. 31, 1998

[51] Int. Cl.[7] ..... F02M 51/00

[52] U.S. Cl. ..... 123/480; 123/492

[58] Field of Search ..... 123/480, 491, 123/492, 493, 435, 478; 701/102

[56] References Cited

U.S. PATENT DOCUMENTS

| | | | |
|---|---|---|---|
| 5,080,071 | 1/1992 | Miniamitani et al. | 123/478 |
| 5,394,857 | 3/1995 | Yamakawa | 123/686 |
| 5,517,968 | 5/1996 | Hori et al. | 123/480 |
| 5,520,153 | 5/1996 | Milunas | 123/480 |
| 5,584,277 | 12/1996 | Chen et al. | 123/480 |
| 5,746,183 | 5/1998 | Parke et al. . | |
| 5,819,714 | 10/1998 | Bush et al. | 123/673 |

*Primary Examiner*—Henry C. Yuen
*Assistant Examiner*—Arnold Castro
*Attorney, Agent, or Firm*—Jerome R. Drouillard; Roger L. May

[57] ABSTRACT

A method and system for determining a quantity of fuel to be injected into a multi-cylinder, internal combustion engine during each combustion event of the engine includes an air flow sensor for sensing a quantity of air flowing through the engine. An electronic control unit is operative to determine a desired combustion fuel quantity based on the quantity of air flowing through the engine and determine a desired fuel injection quantity based on a previous fuel injection quantity delivered during a previous combustion event and the desired combustion fuel quantity. The control unit is further operative to control the amount of fuel injected into the engine for the current combustion event based on the desired fuel injection quantity.

20 Claims, 2 Drawing Sheets

METHOD AND SYSTEM FOR DETERMINING A QUANTITY OF FUEL TO BE INJECTED INTO AN INTERNAL COMBUSTION ENGINE

TECHNICAL FIELD

This invention relates to methods and systems for determining a correct quantity of fuel to be injected into a multi-cylinder internal combustion engine.

BACKGROUND ART

For current model Sequential Electronic Fuel Injection (SEFI) engines, a large effort is required to calibrate fuel injection control to achieve the correct combustion A/F ratio for the engine conditions of cold start and warmup. Calibrations are required for cold fuel enrichment entransient fuel control strategies.

To reduce cold engine hydrocarbon emissions and provide early catalyst light-off, the coordinated strategy for starting with reduced emissions (CSSRE) is applied. To achieve success with the CSSRE strategy, the desired combustion A/F ratio is about 1.04 times stoichiometric (e.g., 1.04*14.55=15.1 A/F ratio). It is difficult to calibrate fuel control to accurately achieve this desired A/F ratio for the pre-catalyst light-off period, because the factors controlling fuel vaporization rates are not predicted.

Several different methods may be utilized to achieve the desired combustion A/F ratio. In a first method, the injection fuel quantity is scheduled with table values as a function of time since start and of the engine coolant temperature. The disadvantage of this method is that the state of gasoline vaporization varies from engine start to start. Injection control utilizing this method generally results in rich A/F ratio.

An improvement to this method is to schedule a fuel injection multiplier which is a function of the engine temperature and the time since engine start. For this method, the base amount of fuel is determined with the mass air flow measurement method of determining the current cylinder air charge. After the oxygen sensor is fully warm, the on-board A/F sensors are available to provide a measurement of exhaust A/F ratio, which is used to correct the fuel injection quantity and provide the proper combustion A/F ratio. However, this feedback information is not available during the first 10–20 seconds after a cold engine start. Furthermore, this method results in rich A/F ratio for good quality gasoline and lean A/F ratio for poor quality gasoline. Thus, emission and driveability results are highly variable for different cold-start conditions.

Thus, there exists a need to accurately predict combustion A/F ratio using as input measured fuel injection quantities and a gasoline vaporization model.

DISCLOSURE OF THE INVENTION

It is thus a general object of the present invention to provide a method and system for determining a correct quantity of fuel to be injected into a multi-cylinder internal combustion engine so as to assure proper open-loop control of the air/fuel ratio for combustion, especially during transient engine conditions.

In carrying out the above object and other objects, features, and advantages of the present invention, a method is provided for determining a quantity of fuel to be injected into a multi-cylinder internal combustion engine during each combustion event of the engine. The method includes sensing a quantity of air flowing through the engine, determining a desired combustion fuel quantity based on the quantity of air flowing through the engine, determining a desired fuel injection quantity based on a previous fuel injection quantity delivered during a previous combustion event and the desired combustion fuel quantity, and controlling the amount of fuel injected into the engine for the current combustion event based on the desired fuel injection quantity.

In further carrying out the above object and other objects, features, and advantages of the present invention, a system is also provided for carrying out the steps of the above described method. The system includes an air flow sensor for sensing a quantity of air flowing through the engine. The system further includes an electronic control unit operative to determine a desired combustion fuel quantity based on the quantity of air flowing through the engine, determine a desired fuel injection quantity based on a previous fuel injection quantity delivered during a previous combustion event and the desired combustion fuel quantity, and control the amount of fuel injected into the engine for the current combustion event based on the desired fuel injection quantity.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
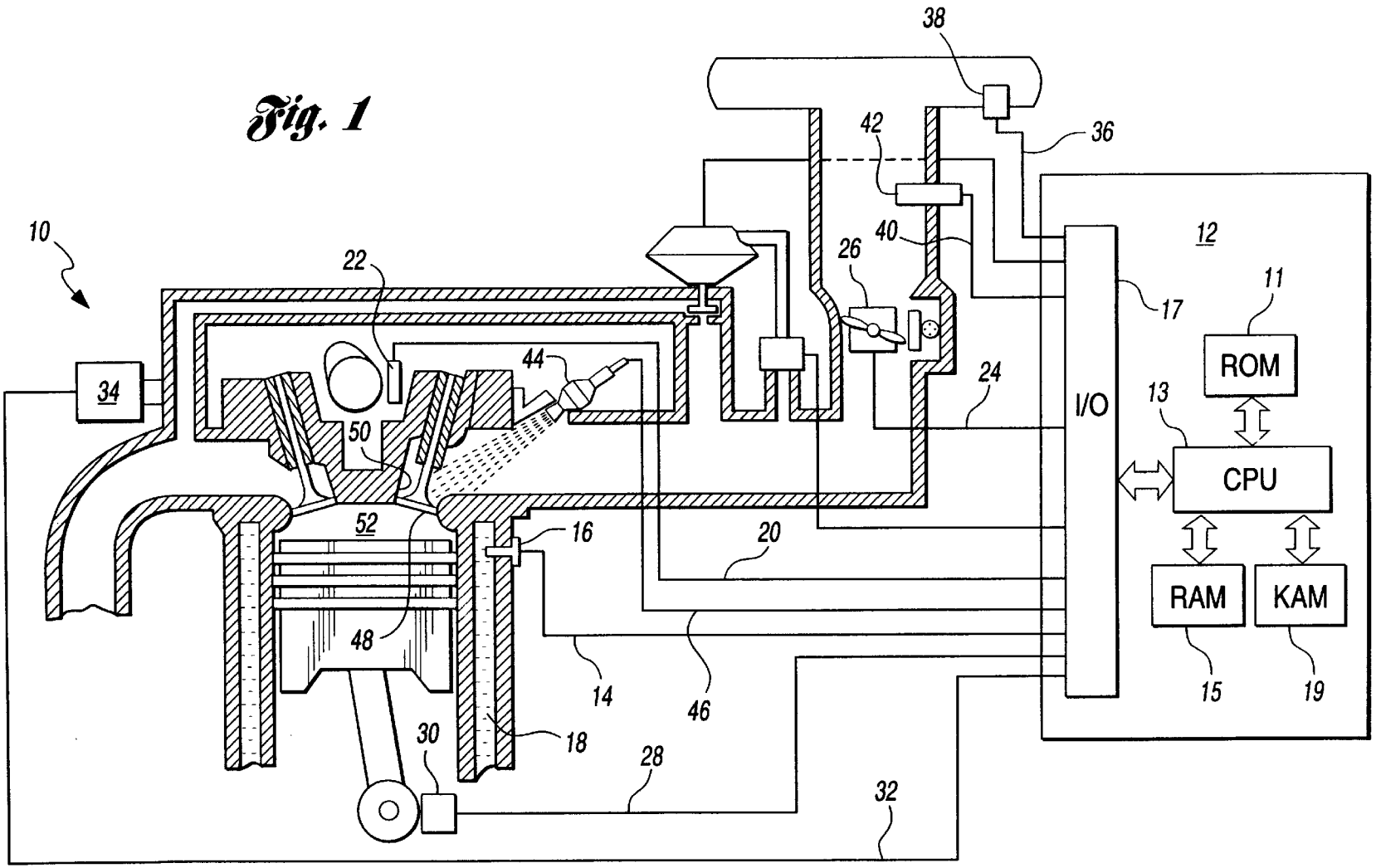
FIG. 1 is a schematic diagram of an internal combustion engine and an electronic engine controller which embody the principles of the present invention.

Turning now to FIG. 1, there is shown a schematic diagram of an internal combustion engine which incorporates the teachings of the present invention. The internal combustion engine 10 comprises a plurality of combustion chambers, or cylinders, one of which is shown in FIG. 1. The engine 10 is controlled by an Electronic Control Unit (ECU) 12 having a Read Only Memory (ROM) 11, a Central Processing Unit (CPU) 13, a Random Access Memory (RAM) 15, and a Keep Alive Memory (KAM) 19, which retains information when the ignition key is turned off for use when the engine is subsequently restarted. The ECU 12 can be embodied by an electronically programmable microprocessor, a microcontroller, an application-specific integrated circuit, or a like device to provide the predetermined control logic.

The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26 indicating the position of a throttle plate (not shown) operated by a driver, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, an air charge, or flow, signal 40 from a mass air flow (MAF) sensor 42.

The ECU 12 processes these signals and generates corresponding signals, such as a fuel injector pulse waveform signal transmitted to the fuel injector 44 on signal line 46 to control the amount of fuel delivered by the fuel injector 44. ECU 12 also generates a combustion initiation signal (not shown) for receipt by a spark plug (not shown, but positioned in same opening as IPS 25) to initiate combustion of the air and fuel in the cylinder.

Intake valve 48 operates to open and close intake port 50 to control the entry of the air/fuel mixture into combustion chamber 52.

The method of the present invention assists in providing an optimal A/F ratio mixture for a burn process designed to deliver the minimum emission constituents from the vehicle. A desired combination of mass of air and vapor is needed in order to provide the optimum A/F ratio. However, an estimated fuel injection quantity, which is a liquid rather than a vapor, is the only controlled variable for providing the correct amount of gasoline vapor. Therefore, the difference between the mass of injected liquid and the desired combustion vapor mass must be determined.

The first part of the method consists of numerically simulating the separation of the injected liquid into different liquid components based on the mass fractions of the different hydrocarbon components in the test fuel. The second part consists of predicting the vaporization rates for the different liquid components. Low boiling point fractions have high vapor rates, while high boiling point fractions have low vapor rates. The vaporization rate constants for the different liquid components are significantly different and are modeled to be functions of the temperature state of the engine. The third part consists of summing the total vapor from the different liquid components and comparing the total predicted vapor quantity to the desired combustion fuel quantity. In the fourth part, an iterative procedure is defined to predict and correct the injection fuel quantity, until the prediction of vapor mass is within a predetermined accuracy range of the desired combustion fuel quantity. Alternatively, a closed-loop control algorithm may be used to determine the corrected fuel injection quantity.

Figure 2:
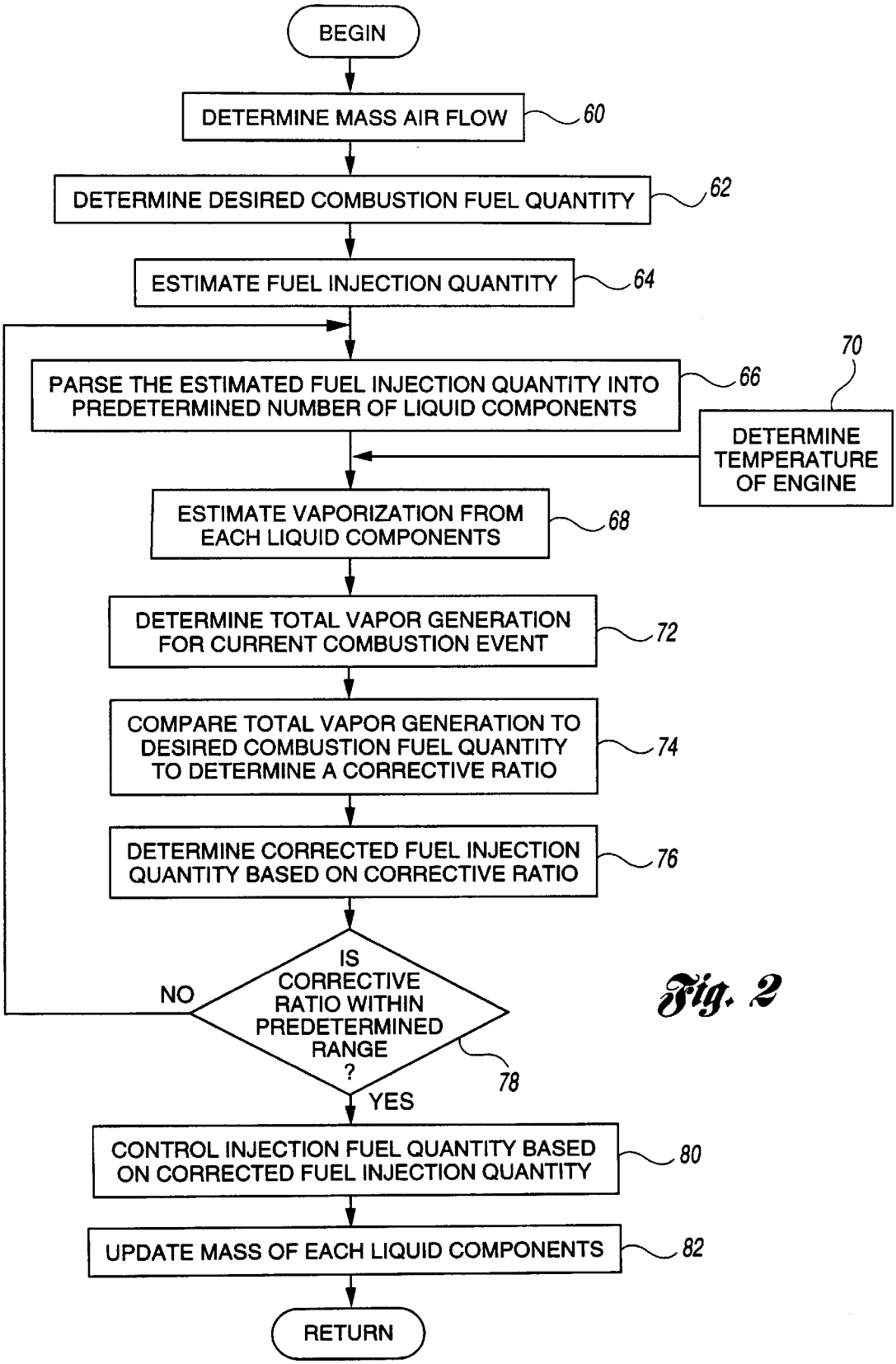
FIG. 2 is a flow diagram illustrating the general sequence of steps associated with the operation of the present invention.

Turning now to FIG. 2, there is shown a flow diagram illustrating the general sequence of steps associated with the method of the present invention. Although the steps shown in FIG. 2 are depicted sequentially, they can be implemented utilizing interrupt-driven programming strategies, object-oriented programming, or the like. In a preferred embodiment, the steps shown in FIG. 2 comprise a portion of a larger routine which performs other engine control functions.

The method begins with the step of sensing the air charge via MAF 42, as shown at block 60. The desired combustion fuel quantity is then determined, as shown at block 62, according to the following:

$$cmbfq[lbm\ \text{fuel/stroke}]=\text{Air_Charge}*Kamrf/(\text{Stoich A/F}*Lambse*OLMCL) \quad \text{(Eq. 1)}$$

where, cmbfq=desired combustion fuel quantity, or fuel vapor mass;

Air_Charge=air charge signal sensed by MAF 42;

Kamrf=a fuel multiplier adapted to keep the open-loop air/fuel ratio close to stoichiometric;

Stoich A/F=stoichiometric A/F ratio, e.g., 14.7;

Lambse=a first A/F ratio relative to a stoichiometric A/F ratio; and

OLMCL=a second A/F ratio relative to a stoichiometric A/F ratio.

Next, an estimated fuel injection quantity is determined, as shown at block 64. This quantity is estimated utilizing either the iterative procedure or the closed-loop algorithm. Illustrated in FIG. 2 is the iterative procedure. In this case, the best estimate for the fuel injection quantity is the previous value of injection fuel, as calculated for the previous cylinder (not the same as the previous value for the current cylinder). For initialization purposes, an estimate of the fuel injection quantity can be the fuel quantity corresponding to an EEC load of 0.5 as follows:

$$injfq[lbm\ \text{fuel/stroke}]=0.5*Sarchg/14.6 \quad \text{(Eq. 2)},$$

where,

Sarchg=air charge signal sensed by MAF 42 at standard pressure and temperature; and EEC load=the ratio of current mass of air per combustion event to a mass of air filling the engine cylinder at standard pressure and temperature. When the engine is fully warmed up, the maximum EEC load is about 0.75. During deceleration conditions, with closed throttle, the minimum EEC load is about 0.10. Therefore, a value of EEC load=0.5 means the engine cylinder is about ⅔ of maximum air charge.

The estimated fuel injection quantity is then parsed into a predetermined number of liquid components, as shown at block 66. This multi-component transient injection fuel control method considers the vaporization of the full range of fuel components, from the low boiling point fractions, to the highest boiling point fraction. This method recognizes that the vaporization process is occurring at many different locations within the engine, from the location of injection, to the cylinder walls and crank case. Other transient control methods consider only a singular wall wetting history and/or a single evaporation time constant.

With the multi-component transient injection fuel control method, the overall thermal environment of the engine is estimated and applied to calculate the vaporization rate constants for the different boiling-point fractions of the fuel. This method recognizes that the low boiling point liquid fractions have a short residence time in the engine, and that the highest boiling liquid fractions have a significantly longer residence time in the engine. Residence time is defined as the time from port injection to the time when there is significant impact on measured variables, such as exhaust A/F ratio. To account for nearly all variations of the thermal environment of the engine, the fuel should be subdivided into at least three, preferably five, different boiling point fractions, each of which has a different set of vaporization time constants as a function of the engine thermal environment.

For example, for Indolene gasoline, the following parsing scheme is chosen:

| | |
|---|---|
| Low Boiling Point Component 1, | Mass Fraction = 0.18 |
| Liquid Component 2, | Mass Fraction = 0.25 |
| Liquid Component 3, | Mass Fraction = 0.32 |
| Liquid Component 4, | Mass Fraction = 0.20 |
| High Boiling Point Component 5, | Mass Fraction = 0.05 |
| | Total = 1.00 |

These values are set during initialization and are based on the boiling point composition of unweathered gasoline. This scheme could be modified during engine operation, to account for tank weathering, with adaptive algorithms.

This composition parsing function is calibratable for the expected fuel for the vehicle. Other gasolines may be parsed as follows: 1) For California Phase II summer gasoline, the mass fractions for liquid components 1–5=0.17, 0.38, 0.24, 0.18 and 0.03, respectively; 2) For cold start winter gasoline, the mass fractions for liquid components 1–5=0.26, 0.29, 0.21, 0.18 and 0.06, respectively; 3) For Hesitation fuel, the mass fractions for liquid components 1–5=0.15, 0.24, 0.23, 0.30 and 0.08, respectively; and 4) For European Hesitation fuel, the mass fractions for liquid components 1–5=0.23, 0.27, 0.24, 0.21 and 0.05, respectively.

The mass in each liquid component can be updated from the previous injection event for the same cylinder. The size increase is based on the current estimated value for the injection fuel quantity as follows:

$$\text{Mass_}L(i)[lbm\ \text{liquid}]=\text{Mass_}L_p(i)+injfq*fl(i),\ \text{for i=1,5,} \quad \text{(Eq. 3)}$$

where,

Mass_L_p(i)=mass for the liquid component, i, for the previous injection event for the same cylinder;

injfq=estimated fuel injection quantity; and fl(i)=mass fraction for the liquid component, i.

Upon initialization, predetermined values are assigned for the variable, Mass_L_p(i). For the time period of 0–5 seconds after a cold start, the prediction of vapor generation with this model is greatly influenced by the initial values of the five liquid component masses. The vapor rates are proportional to the liquid component masses. The size of liquid components 3 and 4, with assumed higher boiling points, significantly affect the prediction of total vapor rate for a cold start at 70 F. At 70 F, the vapor rate from liquid component 5 is normally very low. The liquid component sizes of 1 and 2 reach equilibrium within one second of the cold start, independent of the initial values.

One possibility for a cold start is that the engine was fully warm and lightly loaded prior to the shutdown. Therefore, the liquid components should be fully depleted, especially if a 12-hour soak preceded the cold start. A second possibility for a cold start is the case of a stall following only two seconds of cold operation. In this case for the restart, the liquid components have significantly more mass and higher vaporization rates. As long as the liquid component mass values are kept in memory between the stall and the restart (comparing cases of equal EEC Load), the gasoline vaporization model will calculate less injection fuel following the restart.

To provide initial values for cases of partial engine warmup before shutdown, and short soak times, the liquid component values at the time of shutdown need to be stored in KAM 19.

Alternative algorithms are possible to modify the size of the liquid component mass for cold start conditions. For example, an anti-stall fuzzy logic strategy could modify the size of the liquid component if lean or rich fueling is suspected. Also, input from a fast-light-off HEGO sensor can be used to modify the values of the liquid component masses. If leanness is indicated during the time period of 5–10 seconds after a cold start, then the liquid component sizes need immediate reduction, which would result in the calculation of higher injection fuel quantity.

Returning now to FIG. 2, the method proceeds to block 68 in which the vaporization from each liquid component is estimated. An essential element of the present invention is the estimation of vapor generation from all sources, i.e., from the injection event to the combustion event. This is simulated by assuming the five liquid components have significantly different vaporization rate constants. The vaporization rate constants are assumed to be a function of an estimated temperature of the engine, as shown at block 70.

The vaporization from each of the five liquid components, Mvap_L(i), is determined as follows:

$$Mvap_L(i)[lbm\ \text{vapor per combustion event}]=\text{Vrate_}L(i)*\text{Mass_}L(i),\ \text{for i=1–5} \quad \text{(Eq. 4),}$$

where,

Vrate L(i)=vaporization rate constant, which is a function of engine temperature, or Absolute Temperature Scale (ATS), i.e., Vrate_L(i)=vrc(i,ATS); and Mass_L(i)=current size of the liquid component.

Liquid vaporization rates can be characterized as an exponential function of the liquid temperature. This temperature dependency is assumed to be different for the five liquid components consisting of different boiling-point components. Functions are given below for the temperature dependency of the vaporization rate constants for the five liquid components. Since these rate constants change slowly as the engine thermal environment changes, these functions can be evaluated in a background routine, with an accuracy of about five percent.

Thus, the values for the rate constants, vrc(i, ATS) are:

| | | | | | | |
|---|---|---|---|---|---|---|
| GVM5_ATS = 1.0 | .0999 | .0250 | .00624 | .00156 | .00039 | Cold |
| 1.1 | .1776 | .0444 | .0111 | .0028 | .00069 | |
| 1.2 | .3157 | .0789 | .0197 | .0049 | .00123 | |
| 1.3 | .5612 | .1403 | .0351 | .0088 | .0022 | |
| 1.4 | .9976 | .2494 | .0623 | .0156 | .0039 | |
| 1.5 | 1 | .4433 | .1108 | .0277 | .0069 | |
| 1.6 | 1 | .7881 | .1970 | .0493 | .0123 | |
| 1.7 | 1 | 1 | .3503 | .0876 | .0219 | |
| 1.8 | 1 | 1 | .6226 | .1557 | .0389 | |
| 1.9 | 1 | 1 | 1 | .2767 | .0692 | |
| 2.0 | 1 | 1 | 1 | .4919 | .123 | |
| 2.1 | 1 | 1 | 1 | .8744 | .2186 | |
| 2.2 | 1 | 1 | 1 | 1 | .3886 | |
| 2.3 | 1 | 1 | 1 | 1 | .6908 | |
| 2.4 | 1 | 1 | 1 | 1 | 1 | HOT |
| Component pool (i) = | 1 | 2 | 3 | 4 | 5 | |
| | Low B.P. | | Mid-Range B.P. | | High B.P. | |

Note that all the rate constants are less than one. The significance of the value of 1.0 is that all liquid, for that component, vaporizes during the current combustion event. As the temperature of the engine increases, more of the rate constants approach 1.0. For very cold engine starting conditions, there is considerable delay of vaporization for all five components. For very hot, fully warm engine conditions, the vaporization of only the two high boiling point components are delayed.

Equations were formulated to calculate useful values for the vaporization rate constants, vrc. These equations are:

$$\text{First } vrc=0.000317*Exp(5.753*ATS) \quad \text{(Eq. 5)}$$

$$\text{Second } vrc=\text{First } vrc/4 \quad \text{(Eq. 6)}$$

$$\text{Third } vrc=\text{First } vrc/16 \quad \text{(Eq. 7)}$$

$$\text{Fourth } vrc=\text{First } vrc/64 \quad \text{(Eq. 8)}$$

$$\text{Fifth } vrc=\text{First } vrc/256 \quad \text{(Eq. 9)}$$

A temperature scale must be chosen to apply the functions for the vaporization rate constants. The temperature should relate to the energy state of the engine, which influences liquid vaporization. An arbitrary absolute temperature scale is chosen with 1.0 representing the coldest possible metal temperatures of, for example, a cold soak at −40 F. At this temperature, the heaviest gasoline components will not vaporize. The lightest gasoline components are assumed to have a delay through the engine.

At the highest end of the absolute temperature scale, all gasoline components will vaporize during the current combustion event. Note that even for a fully warm engine, air/fuel transients are observed. Therefore, a temperature scale of 2.0 can represent, for example, 4000 RPM, EEC Load of 0.6, and an engine coolant temperature of 240 F.

The temperature scale should be related to the coolant temperature, and should be increased by a factor relating to the cumulative combustion energy release for the past 5–30 seconds. From engine mapping experience, it is known that more than five minutes are required to stabilize engine temperatures, following a transition to a different speed load condition.

One possible model for the temperature scale could be:

$$ATS=0.00255*(460+ECT+k_heat*\text{Sum over all events per cylinder, during the last 20 seconds, of EEC Load per event}) \quad \text{(Eq. 10)}$$

where,

ECT=engine coolant temperature; and k_heat=multiplying parameter relating heat transfer from previous combustion events.

This equation gives a value of ATS=1.35 for a cold start at 70 F, where the sum of heat release is zero. This equation also gives an ATS=1.71 for a hot start at 210 F. Based upon experimentation, the temperature scale increases about 0.1 for the effect of combustion at an EEC Load of about 0.4 at 1500 RPM.

Returning again to FIG. 2, the iterative method proceeds to determine the total vapor generation for the current combustion event, as shown at block 72, where Mvap_tot=Mvap_L(1)+Mvap_L(2)+Mvap_L(3)+Mvap_L(4)+Mvap_L(5). The total vapor generation is then compared to the desired combustion fuel quantity to determine a corrective ratio, as shown at block 74. The corrective ratio, Mvap_ratio, is determined according to the following:

$$Mvap_\text{ratio}=cmbfq/Mvap_tot. \quad \text{(Eq. 11)}$$

If the corrective ratio is greater than one, the A/F ratio would be lean, and more fuel must be injected than was estimated above. If the ratio is less than 1, the A/F ratio would be rich, and less fuel must be injected than was estimated above. In either case, the estimate for the fuel injection quantity can be corrected, block 76, utilizing the corrective ratio:

$$injfq=injfq*Mvap_\text{ratio}. \quad \text{(Eq. 12)}$$

This predictor-corrector type of iterative method to calculate the injection fuel quantity is stable because the corrective ratio is close to 1.0. Also, the starting value of the injection quantity is the last value for the previous cylinder, and only small changes are expected between successive combustion events.

Next, a determination is made as to whether or not the corrective ratio is within a predetermined range, as shown at conditional block 78. If the corrective ratio is outside the predetermined range, then steps 66–76 are repeated with the new estimate of injection fuel quantity. For A/F ratio control within one percent, the error criteria should be one percent of the desired combustion fuel quantity. That is, if (1+0.01) <Mvap_ratio<(1−0.01), then return to block 66. This iterative process may be kept to a predetermined maximum such as, for example, 5 iterations.

If the corrective ratio is within the predetermined range, then the method proceeds to control the injection fuel quantity, as shown at block 80. The calculated injection fuel quantity is output to the injector driver routine for the correct injector. Upper and lower bounds for the injection fuel quantity can be set, such as:

$$\text{Max}(injfq)=20*0.8*(Sarchg/\text{Stoich A/F}) \quad \text{(Eq. 13)}$$

$$\text{Min}(injfq)=0.0 \quad \text{(Eq. 14)}$$

Finally, the masses of the liquid components are updated due to vaporization, as shown at block 82. The iterative procedure of the present invention requires stored values for "old" values of the size of each of the liquid components. In effect, the saved value of each liquid component mass is equivalent to the old saved value for the current cylinder, plus an addition from the injection event, minus the mass vaporized during the current combustion event. Thus, the liquid component mass is decremented as follows:

$$\text{Mass}_L_p(i)=\text{Mass}_L(i)-Mvap_L(i), \text{ for i-1,5,} \quad \text{(Eq. 15)}$$

with a minimum value of zero.

As mentioned above, a closed-form type of control algorithm may be used to determine the corrected fuel injection quantity. Prior to any combustion event, there is a liquid film composed of five known components representing five different boiling point ranges. Old_Liquid(i) are known for i=1,5 [Pounds mass liquid fuel, in component (i), in a cylinder]. The injected liquid fuel is parsed, P(i) i=1,5, into five liquid components so that:

$$\text{New_Liquid}(i)=\text{Old_Liquid}(i)+P(i)*Qf_inj, \quad \text{(Eq. 16)}$$

where, Qf_inj is the unknown corrected fuel injection quantity, and P(i) represents the five parsing fractions for describing the vaporization quality of the liquid gasoline for each injection event.

Vaporization rate constants, VRC(i), are assigned to the five different liquid components. The rates are defined, for the current combustion event, as a fraction of the liquid in the given component which vaporizes during the current combustion event. As the boiling point increases for successive liquid components, the vaporization rate constants get smaller. For cold engine conditions, all five VRC(i)'s are much smaller than 1.0. For very hot engine conditions, all five VRC(i)'s can approach the value 1.0. For a cold start at 70 F, the VRC(i) for the "lightest" gasoline component (higher boiling point) may approach the value 1.0. VRC(i) is evaluated for i=1,5, and the vaporization from all liquid components is the sum of the vaporization of the five components:

$$\text{Total vapor}=\text{sum of } (VRC(i)*(\text{Old_Liquid}(i)+P(i)*Qf_inj) \text{ for } i=1,5 \quad \text{(Eq. 17)}$$

where the injected fuel quantity is the unknown value for the current injection event. The control problem is to calculate the injected fuel mass, such that the total vapor is equal to the desired combustion fuel quantity.

The desired combustion fuel quantity, Qf_comb, is known from the mass-air fuel control strategy, which is modified by manifold filling and the desired A/F ratio, i.e., Qf_comb=(Qair/desired A/F ratio ), where Qair is cylinder air charge.

The desired combustion fuel quantity must be matched by total vapor generated prior to the time of 100% burn for the current combustion event. Therefore, $$Qf_comb=\text{Total_Vapor}=\text{sum of } (VRC(i)*[\text{Old_Liquid}(i)+P(i)*Qf_inj]) \quad \text{(Eq. 18)}$$

After rearrangement, $$Qf_comb=\text{Sum } (VRC(i)*\text{Old_Liquid}(i))+Qf_inj*\text{Sum } (VRC(i)*P(i)) \quad \text{(Eq. 19)}$$

This equation is rearranged again to solve for the injection fuel quantity:

$$Qf_inj=[(Qair/\text{A/F ratio})-(\text{sum of 5 vapors from 5 old liquids})]/(\text{sum of products, } P(i)*VRC(i) \quad \text{(Eq. 20)}$$

This particular rearrangement of terms helps to minimize the computational effort in the foreground procedures. The divisor, (sum of products, P(i)*VRC(i)), is completed in a background routine. The vaporization calculation, the summing, and the calculation of injection fuel quantity are completed in a foreground routine.

The new mass of each liquid component is updated, every combustion event, after the injection fuel quantity is determined as follows:

$$\text{New_Liquid}(i)=\text{Old_Liquid}(i)-VRC(i)*\text{Old_Liquid}(i)+Qf_inj*P(i)-Qf_inj*P(i)*VRC(i) \quad \text{(Eq. 21)}$$

These terms can be rearranged, for convenience, to solve for the new liquid quantities. This rearrangement helps to minimize the computation time in the foreground procedures, i.e., transferring calculations to the background procedures. For all liquid components, i.e., for i=1 to 5:

$$\text{New liquid}(i)=\text{Old liquid}(i)-(\text{vapor from old liquid}(i))+Qf_inj*[P(i)*(1-\text{Vapor rate constant } (i) \quad \text{(Eq. 22)}$$

where the values in brackets, [P(i)*(1−Vapor rate constant (i))], is completed in a background routine.

The method of the present invention is essentially several different single-time constant models acting in parallel. While a single-time constant model, such as the X-Tau model, has a closed solution, this method includes an iterative procedure to calculate the correct injection fuel quantity based on an estimate of vaporization from the various boiling point components of gasoline. By separating the vaporization prediction into five parts, the effect of the thermal state of the engine on the liquid components can be predicted separately. During engine transients, especially cold transients, the present invention accounts for vaporization dynamics from the different liquid components so to provide the desired combustion A/F ratio.

While the best modes for carrying out the invention have been described in detail, those familiar with the art to which this invention relates will recognize various alternative designs and embodiments for practicing the invention as defined by the following claims.

What is claimed is:

1. A method for determining a quantity of fuel to be injected into a multicylinder internal combustion engine during each combustion event of the engine, the method comprising:

sensing a quantity of air flowing through the engine;

determining a desired combustion fuel quantity based on the quantity of air flowing through the engine, the desired combustion fuel quantity representative of a desired mass of vapor to be injected into the engine;

determining a desired fuel injection quantity based on a previous fuel injection quantity delivered during a previous combustion event and the desired combustion fuel quantity, including parsing the previous fuel injection quantity into a plurality of liquid components, each liquid component having a known boiling point range, and assigning a vaporization constant to each of the components; and controlling the amount of fuel injected into the engine for the current combustion event based on the desired fuel injection quantity.

2. The method as recited in claim 1 wherein determining the desired fuel injection quantity comprises:

determining a temperature of the engine;

determining an estimated total vapor quantity based on the temperature of the engine for a current combustion event; and comparing the estimated total vapor quantity to the desired combustion fuel quantity.

3. The method as recited in claim 2 wherein determining the estimated total vapor quantity comprises:

parsing the previous fuel injection quantity into a plurality of liquid components, each liquid component having a mass; and estimating an amount of vaporization generation from each of the liquid components based on the mass of each of the liquid components.

4. The method as recited in claim 3 wherein estimating the amount of vaporization generation from each of the liquid components includes determining a vaporization rate constant for each of the liquid components based on the temperature of the engine.

5. The method as recited in claim 2 wherein comparing the estimated total vapor quantity comprises:

determining a first corrective ratio based on a difference between the desired combustion fuel quantity and the estimated total vapor quantity;

determining if the first corrective ratio is within a predetermined range; and if not, determining a second corrective ratio based on the first corrective ratio, wherein the second corrective ratio includes a corrected estimate of vaporization from a modified injection fuel quantity.

6. The method as recited in claim 5 wherein controlling the amount of fuel injected into the engine includes controlling the amount of fuel based on one of the first and second corrective ratios.

7. The method as recited in claim 1 wherein determining the desired fuel injection quantity includes determining a total vaporization from each of the components based on the vaporization constant of each component.

8. The method as recited in claim 7 wherein determining the desired fuel injection quantity further includes determining a total of a product of each of the boiling point ranges and vaporization constants of each of the components.

9. The method as recited in claim 1 wherein the desired fuel injection quantity includes a mass and wherein the method further comprises updating the mass based on the previous fuel injection quantity and the desired fuel injection quantity.

10. A system for determining a quantity of fuel to be injected into a multicylinder internal combustion engine during each combustion event of the engine, the system comprising:

an air flow sensor for sensing a quantity of air flowing through the engine; and an electronic control unit operative to determine a desired combustion fuel quantity based on the quantity of air flowing through the engine wherein the desired combustion fuel quantity is representative of a desired mass of vapor to be injected into the engine, determine a desired fuel injection quantity based on a previous fuel injection quantity delivered during a previous combustion event and the desired combustion fuel quantity, and control the amount of fuel injected into the engine for the current combustion event based on the desired fuel injection quantity, wherein the electronic control unit, in determining the desired fuel injection quantity, is further operative to parse the previous fuel injection quantity into a plurality of liquid components, each liquid component having a known boiling point range, and assign a vaporization constant to each of the components.

11. The system as recited in claim 10 further comprising means for determining a temperature of the engine and wherein the electronic control unit, in determining the desired fuel injection quantity, is further operative to determine an estimated total vapor quantity based on the temperature of the engine for a current combustion event and compare the estimated total vapor quantity to the desired fuel quantity.

12. The system as recited in claim 11 wherein the electronic control unit, in determining the estimated total vapor quantity, is further operative to parse the previous fuel injection quantity into a plurality of liquid components, each liquid component having a mass, and estimate an amount of vaporization generation from each of the liquid components based on the mass of each of the liquid components.

13. The system as recited in claim 12 wherein the electronic control unit, in estimating the amount of vaporization generation from each of the liquid components, is further operative to determine a vaporization rate constant for each of the liquid components based on the temperature of the engine.

14. The system as recited in claim 12 wherein the electronic control unit, in comparing the estimated total vapor quantity, is further operative to determine a first corrective ratio based on a difference between the desired combustion fuel quantity and the estimated total vapor quantity, determine if the first corrective ratio is within a predetermined range, and, if not, determine a second corrective ratio based on the first corrective ratio, wherein the first corrective ratio includes a corrected estimate of vaporization from a modified injection fuel quantity.

15. The system as recited in claim 14 wherein the electronic control unit, in controlling the amount of fuel injected into the engine, is further operative to control the amount of fuel based on one of the first and second corrective ratios.

16. The system as recited in claim 11 wherein the electronic control unit, in determining the desired fuel injection quantity, is further operative to determine a total vaporization from each of the components based on the vaporization constant of each component.

17. The system as recited in claim 16 wherein the electronic control unit, in determining the desired fuel injection quantity, is further operative to determine a total of a product of each of the boiling point ranges and vaporization constants of each of the components.

18. The system as recited in claim 10 wherein the desired fuel injection quantity includes a mass and wherein the electronic control unit is further operative to update the mass based on the previous fuel injection quantity and the desired fuel injection quantity.

19. A method for determining a quantity of fuel to be injected into an internal combustion engine during each combustion event of the engine comprising:

numerically simulating parsing of past injected fuel into different liquid components based on mass fractions of different hydrocarbon components used in a test fuel;

predicting vaporization rates for the different liquid components, wherein the vaporization rates for the different liquid components are modeled as a function of a temperature state of the engine;

summing the total vapor from the different liquid components, and comparing the total predicted vapor quantity to a desired combustion fuel quantity; and correcting the fuel quantity to be injected based on the comparison.

20. The method of claim 19 wherein correcting the fuel quantity comprises iteratively predicting and correcting the injection fuel quantity until the prediction falls within a predetermined accuracy range of the desired combustion fuel quantity.

* * * * *